US006398487B1

(12) United States Patent
Wallace et al.

(10) Patent No.: US 6,398,487 B1
(45) Date of Patent: Jun. 4, 2002

(54) METHODS AND APPARATUS FOR SUPPLYING COOLING AIRFLOW IN TURBINE ENGINES

(75) Inventors: Thomas Tracy Wallace, Maineville; Christopher Charles Glynn, Hamilton; Monty Lee Shelton, Loveland; Jeffrey Donald Clements, Mason; Dean Thomas Lenahan; Barry John Kalb, both of Cincinnati, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/616,257

(22) Filed: Jul. 14, 2000

(51) Int. Cl.[7] ..... F01D 5/14

(52) U.S. Cl. ..... 415/115; 415/191; 415/202; 415/208.2

(58) Field of Search ..... 415/1, 115, 157, 415/171, 202, 208.2

(56) References Cited

U.S. PATENT DOCUMENTS 4,541,774 A * 9/1985 Rieck et al. ..... 415/115
4,674,955 A 6/1987 Howe et al.
4,719,747 A * 1/1988 Willkop et al. ..... 60/39.07
4,882,902 A 11/1989 Reigel et al.
5,226,785 A * 7/1993 Narayana et al. ..... 415/115
5,853,285 A 12/1998 Miller et al.
5,997,244 A * 12/1999 Gebre-Giorgis et al. .... 415/115

* cited by examiner

*Primary Examiner*—Edward K. Look
*Assistant Examiner*—Ninh Nguyen
(74) *Attorney, Agent, or Firm*—Rodney M. Young; Armstrong Teasdale LLP

(57) ABSTRACT

A gas turbine engine rotor assembly includes a plurality of aerodynamic devices to direct airflow radially inward. The gas turbine engine rotor assembly includes a rotor shaft that includes a plurality of openings. The aerodynamic devices include a pair of vane segments and a pair of sidewalls. A contoured outer surface includes an opening and permits the aerodynamic device to be positioned against an inner surface of the rotor shaft, and a flange ring defines a pocket. The aerodynamic device fits within the pocket to concentrically align the openings.

18 Claims, 3 Drawing Sheets

METHODS AND APPARATUS FOR SUPPLYING COOLING AIRFLOW IN TURBINE ENGINES

BACKGROUND OF THE INVENTION

This application relates generally to gas turbine engines and, more particularly, to gas turbine engine aerodynamic devices.

A gas turbine engine typically includes a rotor assembly and a plurality of secondary cooling air circuits. To supply air to the secondary air circuits, engines include aerodynamic devices to deliver rotating airflow from one radius to another in order to avoid exceeding swirl limits of the air. One type of aerodynamic device uses a series of chambers which induce controlled rotation of the airflow as the air flows between chambers of various diameters. The chambers are formed either with individual tubes or parallel plates that include partitioning walls. Other known aerodynamic devices include curved passages instead of partitions to turn the flow in an opposite direction and capture a dynamic head of the airflow as well as shorten a height of the aerodynamic device.

For devices which use tubes as chambers, a length of the individual tubes used to form the chamber determines the aerodynamic effect obtained by the chamber. As the length of the tubes is increased, the aerodynamic effect obtained within the chamber is enhanced. However, the increased length of the tubes also increases the weight of the aerodynamic device and may adversely impact structural dynamics of the aerodynamic device. To overcome weight concerns, thin-walled tubes are used to form the chamber. Because thin-walled tubes are more susceptible to vibration, dampers may be installed within the tubes. The dampers increase the weight of the tubes and may increase the tube mean stress.

For devices which use parallel plates as baffles for chambers, during operation, connections between the parallel plates and the passages create multiple stress concentrations that amplify hoop stress present in the plates due to rotation. To reduce the effects of hoop stress concentration, contoured fillets may be installed around the transitional connection areas formed between the plate and partition. The fillets increase the weight of the tubes and increase the assembly costs of the rotor assembly.

BRIEF SUMMARY OF THE INVENTION

In an exemplary embodiment, a gas turbine engine rotor assembly includes a plurality of aerodynamic devices to direct airflow radially inward in a rotating environment for use as cooling air within secondary cooling air circuits. The gas turbine engine rotor assembly includes a rotor shaft that includes a plurality of openings extending between an outer surface of the shaft and an inner surface of the shaft. The rotor shaft also includes a pair of flanges extending radially inward from the shaft inner surface and defining a pocket. Each aerodynamic device includes an opening and a contoured outer surface that permits the aerodynamic device to be positioned flush against an inner surface of the rotor shaft. The aerodynamic devices are sized to fit within the rotor shaft flange pocket and each device also includes a pair of vane segments. The vane segments define a curved passageway that extends from the aerodynamic device opening.

During operation, centrifugal forces generated within the rotor assembly force each aerodynamic device radially outward into each rotor shaft pocket. The rotor shaft flange retains the aerodynamic device such that the aerodynamic device opening and the rotor shaft openings are concentrically aligned. Air flowing through the gas turbine engine at a relatively high tangential velocity is directed radially inward through the aerodynamic devices for use as cooling air within downstream secondary cooling air circuits. The curved shape of the passageway defined by the vane segments causes the airflow to exit the aerodynamic devices after a high turning in an opposite direction, thereby permitting the aerodynamic device to be fabricated with a smaller size than known aerodynamic devices. A reduction in pressure losses due to the airflow re-direction is facilitated and the secondary cooling air circuits receive airflow at a sufficient pressure and temperature. Furthermore, because the aerodynamic devices are not formed circumferentially as a unitary structure, hoop stresses generated within the aerodynamic devices due to centrifugal body loads are reduced in comparison to known aerodynamic devices.

DETAILED DESCRIPTION OF THE INVENTION

Figure 1:
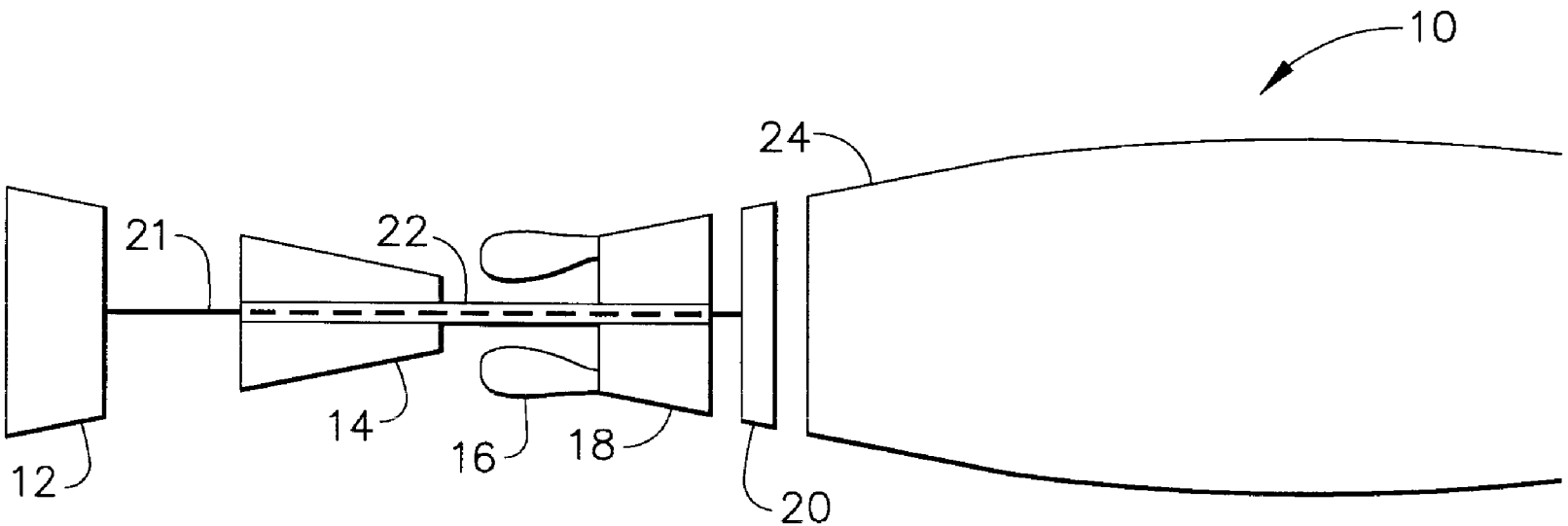
FIG. 1 is a schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Compressor 12 and turbine 20 are coupled by a first shaft 21, and compressor 14 and turbine 18 are coupled by a second shaft 22.

In operation, air flows through low pressure compressor 12 and compressed air is supplied from low pressure compressor 12 to high pressure compressor 14. The highly compressed air is delivered to combustor 16 where it is combined with fuel and burned. Airflow (not shown in FIG. 1) from combustor 16 is exhausted through turbines 18 and 20 to produce power to drive compressors 12 and 14, respectively. Heated airflow then exits gas turbine engine 10 through a nozzle 24.

Figure 2:
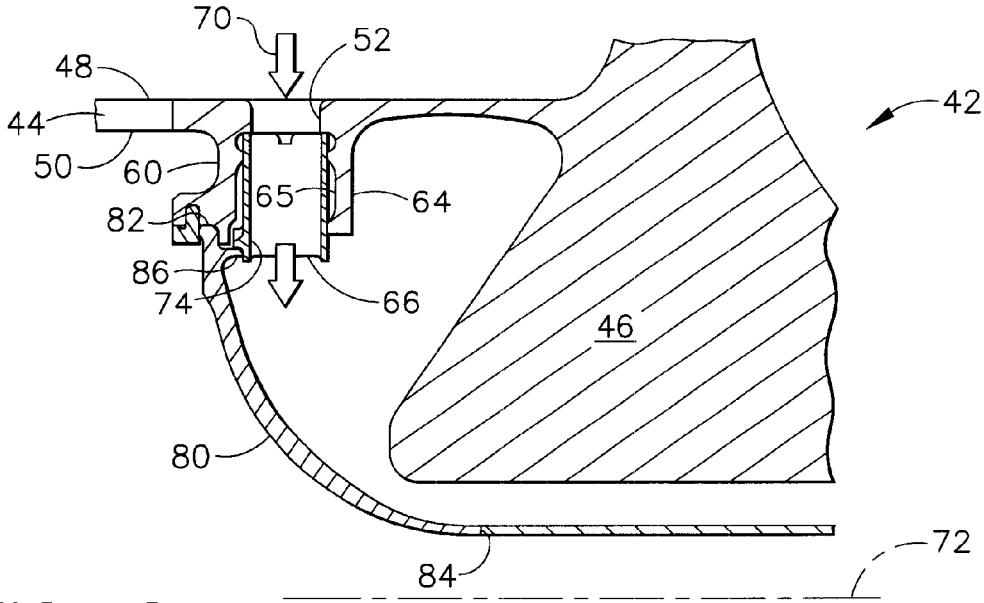
FIG. 2 is a cross-sectional view of the gas turbine engine shown in FIG. 1 including an aerodynamic device.

FIG. 2 is a cross-sectional view of a rotor assembly 42 used with turbine engine 10 (shown in FIG. 1). In one embodiment, rotor assembly 42 is a turbine rotor assembly used with turbines 18 and 20 (shown in FIG. 1). In an exemplary embodiment, rotor assembly 42 includes a rotor shaft 44 and a plurality of rotors 46. In one embodiment, rotor shaft 44 is similar to shaft 22 shown in FIG. 1. Shaft 44 has a substantially circular cross-sectional profile and includes an outer surface 48, an inner surface 50, and a plurality of openings 52 extending therebetween. Outer and inner surfaces 48 and 50, respectively, are curved and substantially parallel and inner surface 50 defines an inner diameter (not shown).

Shaft 44 also includes a pair of annular ring flanges 60 and 64 extending radially inward from shaft inner surface 50. Flanges 60 and 64 define a pocket 65 sized axially and radially to receive a plurality of aerodynamic devices 66 such that each aerodynamic device 66 is positioned adjacent shaft inner surface 50. Shaft opening 52 extends between shaft outer and inner surfaces 48 and 50, respectively, into pocket 65.

A plurality of aerodynamic devices 66 are installed within shaft 44 to deswirl rotating air 70 and deliver air 70 at a reduced absolute velocity into shaft 44 for cooling. In one embodiment, devices 66 are used to supply cooling air 70 to downstream secondary air circuits (not shown). Devices 66, described in more detail below, are coupled circumferentially around a centerline 72 of engine 10 within rotor shaft 44. Each device 66 includes an opening 74 extending generally radially through aerodynamic device 66 with respect to engine centerline 72. Devices 66 are sized to fit within shaft flange pocket 65 such that each device opening 74 is aligned tangentially and axially beneath rotor shaft opening 52 and concentrically with respect to shaft opening 52.

A retaining device or duct 80 attaches to ring flange 60 and extends radially inward from annular flange 60. Duct 80, described in more detail below, includes a retaining lip 86 for engaging each aerodynamic device 66 to radially retain each aerodynamic device 66 within shaft pockets 65. Alternatively, any retaining device may be used that radially retains aerodynamic devices 66 within shaft pockets 65.

During operation, swirling air 70 directed through engine 10 is redirected through aerodynamic devices 66 for use in secondary cooling air circuits. Air 70 enters each aerodynamic device 66 through rotor shaft openings 52 and is channeled radially inward through aerodynamic devices 66 towards engine centerline 72. Air 70 exiting aerodynamic devices 66 is directed axially downstream with duct 80.

Figure 3:
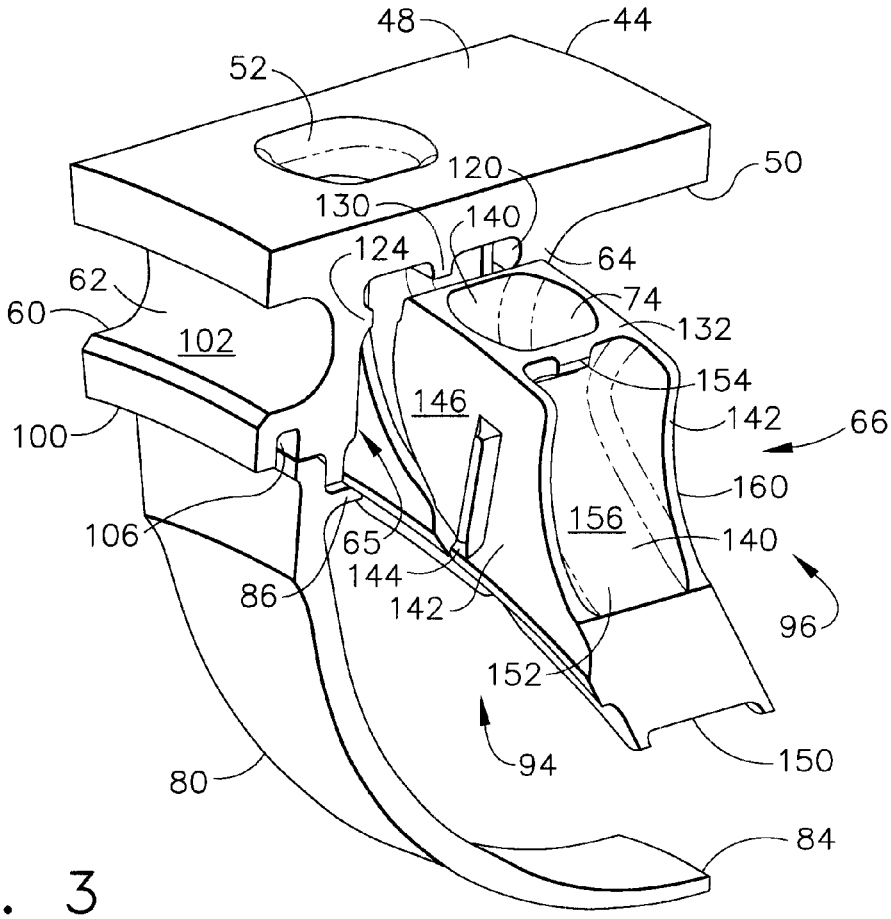
FIG. 3 is a perspective view of an aerodynamic device shown in FIG. 2.

FIG. 3 is a perspective view of aerodynamic device 66 installed within rotor shaft 44 and including a forward side 94, and an aft side 96. In one embodiment, aerodynamic devices 66 are fabricated from standard materials, such as Inconel 718®. In another embodiment, aerodynamic devices 66 are fabricated from light weight intermetallic materials, such as, but not limited to titanium aluminide. Rotor shaft ring flange 60 extends radially inward from rotor shaft inner surface 50 and includes a coupling flange 100 extending axially forward from annular flange 60. Coupling flange 100 includes a groove 106 oriented radially inward toward engine centerline 72. A split ring (not shown) inserted within groove 106 axially retain duct 80.

Ring flanges 60 and 64 each include an inner surface 120. Each inner surface 120 includes a plurality of projections 124 that extend axially into pocket 65. Projections 124 permit flanges 60 and 64 to position aerodynamic device 66 within pocket 65. In one embodiment, flange 60 includes one projection 124 extending into pocket 65 and flange 64 includes two projections 124 extending into pocket 65.

An additional projection 130 extends radially inward from rotor shaft inner surface 50 into pocket 54 and is interrupted with shaft opening 52. Projection 130 is an interlock key that secures aerodynamic device 66 within pocket 65. Projection 130 secures aerodynamic device 66 such that aerodynamic device opening 74 is concentrically aligned with respect to rotor shaft opening 52.

Aerodynamic device 66 includes an upper surface 132, a pair of vane segments 140 and a pair of sidewalls 142. Sidewalls 142 include a projection 144 extending outward from an outer surface 146 of each sidewall 142. Projections 144 are sized to be received within rotor shaft pocket 65 between ring flange projections 124. Sidewalls 142 are substantially parallel and extend radially inward from aerodynamic device upper surface 132 between vane segments 140. Vane segments 140 are curved and extend radially inward from aerodynamic upper surface 132. Vane segments 140 and sidewalls 142 define a curved passageway (not shown in FIG. 3) extending from aerodynamic device opening 74 to a trailing edge 150.

Aerodynamic device upper surface 132 defines aerodynamic device opening 74 and extends between vane segments 140 and sidewalls 142. Upper surface 132 is curved to match a contour defined by rotor shaft inner surface 50 to permit aerodynamic device 66 to form a seal with rotor shaft 44 when installed within rotor shaft pocket 65.

A suction-side vane segment 152 includes a projection 154 extending radially outward from an outer surface 156 of vane segment 152. Projection 154 interlocks with rotor shaft projection 130 to secure aerodynamic device 66 within rotor shaft pocket 65.

During operation, as rotor assembly 40 (shown in FIG. 2) rotates, centrifugal forces generated within rotor assembly 40 force each aerodynamic device 66 radially outward into each rotor shaft pocket 65. Rotor shaft projections 130 and 124 interlock with aerodynamic projections 154 and sidewalls 146 to secure each aerodynamic device 66 within rotor shaft pocket 65 such that a contact face is formed between each aerodynamic device 66 and rotor shaft 44. Furthermore, the combination of projections 124 and 130 prevent aerodynamic device 66 from being installed within shaft pocket 65 in an incorrect orientation.

Because each aerodynamic device upper surface 132 is contoured, a seal is created between each aerodynamic device 66 and rotor shaft inner surface 50. Furthermore, because adjacent aerodynamic devices 66 are positioned circumferentially within rotor shaft 44 and not formed as a 360° structure, hoop stresses generated within aerodynamic devices 66 are reduced in comparison to those generated within known devices. Additionally, because split lines created between adjacent aerodynamic devices 66 are not in the flowpath of air 70 (shown in FIG. 2), aerodynamic efficiency leakage between adjacent aerodynamic devices is limited.

Figure 4:
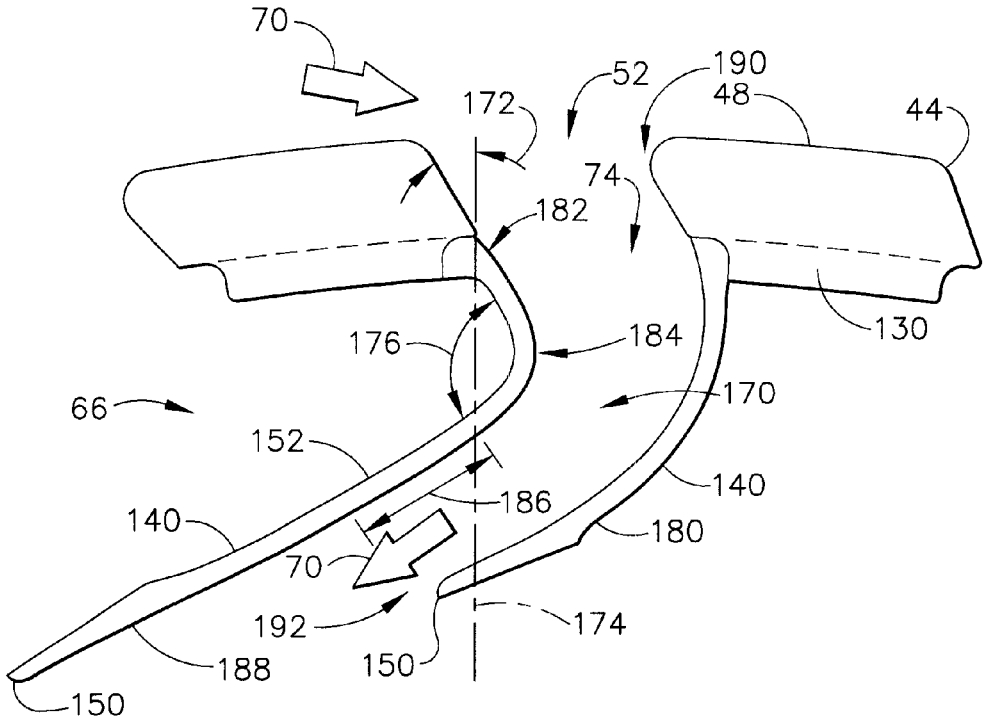
FIG. 4 is a cross-sectional view of the aerodynamic device shown in FIG. 2.

FIG. 4 is a cross-sectional view of aerodynamic device 66 including vane segments 140. Sidewalls 142 (shown in FIG. 3) and vane segments 140 define a curved passageway 170 extending from aerodynamic device opening 74 to trailing edge 150. Curved passageway 170 is in flow communication with rotor shaft opening 52 and aerodynamic device opening 74 is concentrically aligned with rotor shaft opening 52.

Rotor shaft opening 52 extends through rotor shaft 44 at an angle 172 measured with respect to a radial line 174 extending through rotor shaft 44. In one embodiment, angle 172 is approximately 30 degrees from radial and air 70 flows tangentially through engine 10 at an angle of approximately 70° from radial with respect to aerodynamic devices 66. An exit flow angle 176 results in air 70 turning and being deswirled through passageway 170. In one embodiment, exit flow angle 176 is approximately 70 degrees such that air 70 is turned approximately 140°.

Passageway 170 is defined by suction-side vane segment 152 and a pressure side vane segment 180. Vane segments 152 and 180 are curved such that suction side segment 150 has a first region 182, a second region 184, a third region 186, and a fourth region 188. Each subsequent region 184, 186, and 188 extends from a previous region, 182, 184, and 186, respectively. Passageway 170 also includes a leading edge 190, a throat 192, and trailing edge 150.

During operation, as airflow 70 enters aerodynamic device 66, air 70 is likely to separate from suction side vane segment 152 because of a large incidence angle created by the difference between rotor shaft angle 172 and airflow angle, and because rotor shaft angle 172 is limited by mechanical stress constraints. Since separation is likely, to permit aerodynamic device 66 to effectively deswirl air 70, a curvature of passageway 170 permits airflow 70 to re-attach to suction side vane segment 152 such that air 70 may be directed at a desired exit angle 176.

To re-attach air 70 to suction side vane segment 152, passageway 170 includes third region 186 upstream from passageway throat 192. Third region 186 is a long "covered" passageway upstream from passageway throat 192 that permits air 70 to re-attach to suction side vane segment 152. Second region 184 is a region of high curvature that is upstream from third region 186. In other known aerodynamic devices, regions of high curvature, such as second region 184, are undesirable because such regions cause airflow to separate. However, in aerodynamic device 66, airflow separation is presumed, and as such, second region 184 provides advantageous weight considerations to aerodynamic device 66.

The curvature of passageway 170 is further reduced in fourth region 188 from that of third region 186. Fourth region 188 is an "uncovered" portion of passageway 170 and is downstream from throat 192 on suction side vane segment 152. Fourth region 188 permits air 70 exiting aerodynamic device 66 to have a desired exit angle 172 without a possibility of further separation of airflow 70.

Figure 5:
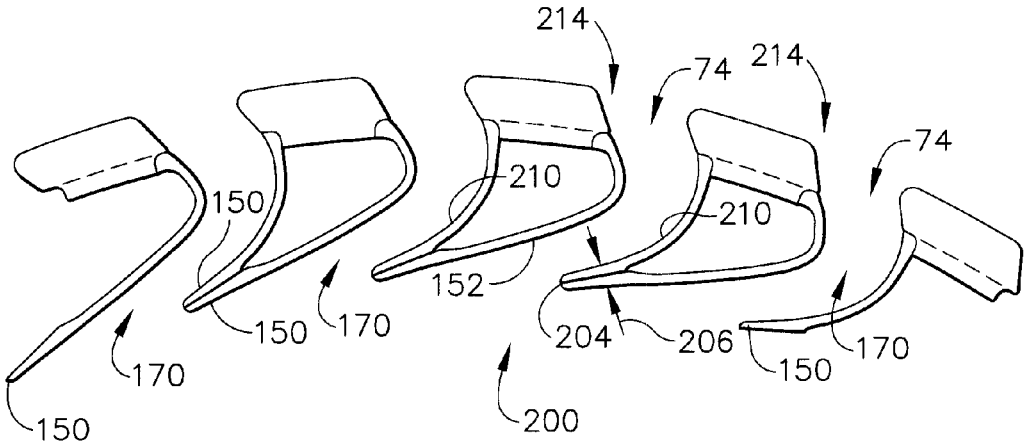
FIG. 5 is a cross-sectional view of a plurality of the aerodynamic devices shown in FIG. 2 in an installed arrangement.

FIG. 5 is a cross-sectional view of a plurality of aerodynamic devices 66 shown in an installed arrangement 200. Adjacent aerodynamic devices 66 are arranged circumferentially within rotor shaft 44 (shown in FIG. 2) such that a trailing edge 204 of each aerodynamic device 60 is formed from adjacent aerodynamic devices 66. Specifically, a thickness 206 of trailing edge 204 is formed from a pressure side vane segment 210 extending from a first aerodynamic device 212 and a suction-side vane segment 152 extending from a second aerodynamic device 214.

The above-described rotor assembly is cost-effective and highly reliable. The aerodynamic devices permit airflow to be deswirled from a higher diameter area through a rotor shaft to a lower diameter, with low stresses induced within the aerodynamic device. Furthermore, the aerodynamic devices permit airflow with a high tangential velocity to be directed radially inward with a low turning loss and without exceeding the swirl limits of the airflow. As a result, an aerodynamic device is provided which directs airflow radially inward for use with secondary cooling air circuits.

While the invention has been described in terms of various specific embodiments, those skilled in the art will recognize that the invention can be practiced with modification within the spirit and scope of the claims.

What is claimed is:

1. A method of supplying rotating airflow within a rotor assembly using a plurality of individual aerodynamic devices, the rotor assembly including a rotor shaft, the aerodynamic devices including a first opening extending therethrough, the rotor shaft including a plurality of openings extending therethrough, said method comprising the steps of:

operating the rotor assembly to transition each aerodynamic device radially within the rotor shaft to concentrically align each aerodynamic device opening with respect to each rotor shaft opening; and channeling airflow through the plurality of aerodynamic devices into the rotor shaft.

2. A method in accordance with claim 1 wherein said step of operating the rotor assembly further comprises the step of securing the aerodynamic device within the rotor shaft with a key.

3. A method in accordance with claim 1 wherein said step of operating the rotor assembly further comprises the step of positioning the aerodynamic device such that an outer surface of the aerodynamic device is flush against an inner surface of the rotor shaft.

4. A method in accordance with claim 1 further comprising the step of positioning aerodynamic devices circumferentially within the rotor shaft such that adjacent aerodynamic devices form a trailing edge.

5. An apparatus for a rotor assembly, said apparatus comprising a plurality of aerodynamic devices extending circumferentially within the rotor assembly and configured to form a curved passage to redirect airflow, each of said aerodynamic devices comprising a first opening extending therethrough, and radially moveable during rotation of the rotor assembly.

6. An apparatus in accordance with claim 5 wherein the rotor assembly includes a rotor shaft, each of said aerodynamic devices sized to be received within a pair of flanges extending from the rotor shaft.

7. An apparatus in accordance with claim 5 wherein each of said aerodynamic devices further comprises a projection configured to position each said aerodynamic device in radial alignment relative to the rotor shaft flange.

8. An apparatus in accordance with claim 5 wherein each of said aerodynamic devices further comprises an outer surface contoured to permit each of said aerodynamic devices to contact flush against the rotor shaft.

9. An apparatus in accordance with claim 5 wherein said aerodynamic device further comprises a first sidewall and a second sidewall.

10. An apparatus in accordance with claim 9 wherein said aerodynamic device further comprises a pair of curved vane segments configured, in the event of separated airflow, to cause such airflow to reattach within said curved passageway.

11. An apparatus in accordance with claim 10 wherein adjacent said aerodynamic devices couple together such that a trailing edge of said apparatus is formed by a first vane segment and a second vane segment.

12. A rotor assembly for a gas turbine engine, said rotor assembly comprising:

a rotor shaft comprising an inner surface, an outer surface, and a plurality of first openings extending therebetween; and a plurality of aerodynamic devices extending circumferentially within said rotor shaft and configured to redirect airflow through said rotor shaft, each of said aerodynamic devices comprising a second opening extending therethrough, and radially moveable during rotation of said rotor shaft.

13. A rotor assembly in accordance with claim 12 wherein said rotor shaft further comprises a pair of flanges extending radially inward from said rotor shaft inner surface, said plurality of aerodynamic devices sized to be received within said pair of rotor shaft flanges such that each said aerodynamic device second opening concentric with each of said rotor shaft first openings.

14. A rotor assembly in accordance with claim 12 wherein said rotor shaft further comprises a key configured to position said aerodynamic device in radial alignment relative to said rotor shaft.

15. A rotor assembly in accordance with claim 12 wherein said aerodynamic device further comprises an outer surface contoured to permit said aerodynamic device to contact flush against said rotor shaft inner surface.

16. A rotor assembly in accordance with claim 12 wherein said aerodynamic device further comprises a first sidewall, and a second sidewall.

17. A rotor assembly in accordance with claim 16 wherein said aerodynamic device further comprises a pair of curved vane segments configured, in the event of separated airflow, to cause such airflow to reattach within said curved passageway.

18. A rotor assembly in accordance with claim 17 wherein adjacent said aerodynamic devices couple to form a trailing edge.

* * * * *